US008811834B2

(12) United States Patent
Yoshida

(10) Patent No.: US 8,811,834 B2
(45) Date of Patent: Aug. 19, 2014

(54) IMAGE FORMING APPARATUS

(75) Inventor: Ken Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 210 days.

(21) Appl. No.: 13/402,290

(22) Filed: Feb. 22, 2012

(65) Prior Publication Data

US 2012/0230706 A1 Sep. 13, 2012

(30) Foreign Application Priority Data

Mar. 7, 2011 (JP) ..... 2011-048556

(51) Int. Cl.

| | |
|---|---|
| ***G03G 15/00*** | (2006.01) |
| ***G03G 15/16*** | (2006.01) |
| ***G03G 15/02*** | (2006.01) |
| ***G03G 15/08*** | (2006.01) |

(52) U.S. Cl.

USPC ..... 399/27; 399/121; 399/55; 399/49; 399/50; 399/72

(58) Field of Classification Search

CPC ..... G03G 15/0136; G03G 15/6511

See application file for complete search history.

(56) References Cited

U.S. PATENT DOCUMENTS

| | | | | |
|---|---|---|---|---|
| 7,003,238 | B2 | 2/2006 | Yoshida et al. | |
| 7,162,179 | B2 | 1/2007 | Yoshida | |
| 7,203,433 | B2 | 4/2007 | Kato et al. | |
| 7,280,792 | B2 | 10/2007 | Sawai et al. | |
| 7,542,713 | B2 | 6/2009 | Yoshida | |
| 7,610,004 | B2 | 10/2009 | Kato et al. | |
| 7,639,976 | B2 | 12/2009 | Yoshida | |
| 7,813,662 | B2 | 10/2010 | Muto et al. | |
| 2004/0136760 | A1 | 7/2004 | Yoshida et al. | |
| 2005/0013636 | A1 | 1/2005 | Sawai et al. | |
| 2005/0147424 | A1 | 7/2005 | Kato et al. | |
| 2005/0254853 | A1 | 11/2005 | Yoshida | |
| 2006/0024076 | A1* | 2/2006 | Kato et al. | 399/49 |
| 2007/0127960 | A1 | 6/2007 | Yoshida | |
| 2007/0134014 | A1 | 6/2007 | Kato et al. | |
| 2007/0280748 | A1 | 12/2007 | Yoshida | |
| 2008/0088883 | A1 | 4/2008 | Yoshida | |
| 2008/0279589 | A1 | 11/2008 | Muto et al. | |

(Continued)

FOREIGN PATENT DOCUMENTS

| | | | |
|---|---|---|---|
| JP | 8-248787 | A | 9/1996 |
| JP | 8-314297 | A | 11/1996 |
| JP | 2001-305823 | A | 11/2001 |
| JP | 2001-312154 | A | 11/2001 |
| JP | 2006-308816 | A | 11/2006 |

*Primary Examiner* — Clayton E Laballe
*Assistant Examiner* — Jas Sanghera
(74) *Attorney, Agent, or Firm* — Harness, Dickey & Pierce, P.L.C.

(57) ABSTRACT

An image forming apparatus includes an image bearing member to bear a toner image, a transfer device to transfer the toner image onto a recording medium, and a moving device controller to control a moving device that moves the transfer device such that the moving device moves the transfer device to contact the image bearing member during transfer of the toner image on the image bearing member to the recording medium; separates the transfer device from the image bearing member as a toner patch on the image bearing member passes through the transfer area; and maintains the transfer device in contact with the image bearing member from a preceding transfer of a toner image to a succeeding transfer of a toner image during continuous printing, as at least one of areas between successive toner images on the image bearing member without the toner patch passes through the transfer area.

16 Claims, 7 Drawing Sheets

(56) References Cited

U.S. PATENT DOCUMENTS

| | | | |
|---|---|---|---|
| 2009/0016784 | A1 | 1/2009 | Yoshida |
| 2009/0196661 | A1 | 8/2009 | Yoshida |
| 2010/0080631 | A1 | 4/2010 | Ogiyama et al. |
| 2010/0098446 | A1 | 4/2010 | Ishikawa et al. |
| 2010/0266300 | A1 | 10/2010 | Yoshida |
| 2011/0103810 | A1 | 5/2011 | Yoshida |
| 2011/0249992 | A1 | 10/2011 | Yoshida |

* cited by examiner

IMAGE FORMING APPARATUS

CROSS-REFERENCE TO RELATED APPLICATION

This patent application is based on and claims priority pursuant to 35 U.S.C. §119 to Japanese Patent Application No. 2011-048556, filed on Mar. 7, 2011 in the Japanese Patent Office, the entire disclosure of which is hereby incorporated by reference herein.

BACKGROUND OF THE INVENTION

1. Field of the Invention

Exemplary aspects of the present invention generally relate to an image forming apparatus, such as a copier, a facsimile machine, a printer, or a multi-functional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In order to reliably obtain a desired image density in image forming apparatuses using an electrophotographic method, such as a copier and a laser beam printer, toner patterns including toner patches which are test images for different toner densities are formed on the image bearing member. The density of the toner patch is detected by an optical detector. Based on the result detected by the optical detector, imaging conditions, for example, a toner density, an LD power, a charging bias, and a developing bias, are adjusted so that the target toner density is obtained.

Generally, such adjustment of the toner density is performed after the power is turned on or at certain intervals after completion of a print job. In order to stabilize the image density during continuous imaging operation, the toner pattern is formed at specific times, such as between successive images to be printed, and is detected by the optical detector to adjust the toner density.

In the image forming apparatus using an intermediate transfer method, the toner patch formed on the image bearing member such as a photoconductor is transferred onto an intermediate transfer member, and then the toner patch is detected by the optical detector.

In such an image forming apparatus, a recording medium is transported to a secondary transfer area between the intermediate transfer member and a secondary transfer member where the toner image on the intermediate transfer member is transferred secondarily onto the recording medium. The toner patch is formed between successive images so that the toner patch does not contact the recording medium in the secondary transfer area to prevent toner adhered to the toner pattern from sticking to the recording medium.

Although contamination of the recording medium can be prevented, as the toner patch passes through the secondary transfer area, in the absence of the recording medium the toner patch instead contacts undesirably the secondary transfer member disposed opposite the intermediate transfer member in the secondary transfer area. As a result, the secondary transfer member gets contaminated by the toner of the toner patch, and then the toner adhered to the secondary transfer member sticks to a rear surface of a subsequent recording medium.

To address this problem, sheet detector can be disposed upstream from the secondary transfer area in the direction of conveyance of the recording medium to detect the recording medium. When the sheet detector detects the recording medium, the secondary transfer member is separated from the intermediate transfer member. In this configuration, the secondary transfer member contacts the intermediate transfer member only when the recording medium enters the secondary transfer area, thereby preventing the toner of the toner pattern adhered to the intermediate transfer member between the successive images on the recording medium from sticking to the secondary transfer member.

Although advantageous, during continuous printing, the secondary transfer member needs to contact and separate from the intermediate transfer member repeatedly between successive recording media sheets. Generally, in order to increase productivity during continuous printing, the imaging speed is increased and/or a distance between successive recording media sheets is reduced.

More specifically, the secondary transfer member needs to be separated from the intermediate transfer member after the trailing edge of the preceding recording medium passes through the secondary transfer area, but needs to contact again the intermediate transfer member before the front edge of the subsequent recording medium arrives at the secondary transfer area, thereby complicating efforts to increase imaging speed and hence productivity for continuous printing operation.

To counteract such difficulty, the moving speed of the secondary transfer member separating from and contacting the intermediate transfer member may be increased. However, increasing the speed of movement of the secondary transfer member intensifies vibration, hence adversely affecting imaging operation.

Although the problems described above relate to the movement of the secondary transfer member relative to the intermediate transfer member, similar problems may occur in an image forming apparatus using a direct transfer method in which the toner image is transferred directly from an image bearing member such as the photoconductive member onto the recording medium in a transfer area between and the image bearing member and the transfer member.

Furthermore, the recording medium may be contaminated when degraded toner in the developing device is discharged forcibly onto the image bearing member between successive images (toner images) when degraded toner is replaced with fresh toner.

There is thus demand for an image forming apparatus capable of preventing contamination of the recording medium without degrading productivity during continuous printing.

BRIEF SUMMARY

In view of the foregoing, in an aspect of this disclosure, an image forming apparatus includes an image bearing member, a transfer device, a sheet transport device, a moving device, a toner patch forming device, and a moving device controller. The image bearing member bears a toner image on a surface thereof based on image information. The transfer device is disposed opposite the image bearing member to form a transfer area therebetween and transfer the toner image onto a recording medium in the transfer area. The sheet transport device transports the recording medium to the transfer area. The moving device coupled to the transfer device moves the transfer device to alternately separate from and contact the image bearing member. The moving device moves the transfer device to contact the image bearing member when the toner image is transferred onto the recording medium. The toner patch forming device forms a toner patch comprising toner not to be transferred onto the recording medium for adjustment of a density of toner on the image bearing member between successive toner images during continuous printing. The moving device controller is operatively connected to the moving device and controls the moving device such that the moving device moves the transfer device to contact the image bearing member during transfer of the toner image on the image bearing member to the recording medium, separates the transfer device from the image bearing member as the toner patch on the image bearing member passes through the transfer area, and maintains the transfer device in contact with the image bearing member from a preceding transfer of a toner image to a succeeding transfer of a toner image during continuous printing, as at least one of areas between successive toner images on the image bearing member without the toner patch passes through the transfer area.

In another aspect of this disclosure there is provided a toner density control method for use in an image forming apparatus. The method includes moving the transfer device to contact the image bearing member during transfer of the toner image on the image bearing member onto the recording medium using the moving device controller to control the moving device, separating the transfer device from the image bearing member as the toner patch on the image bearing member passes through the transfer area using the moving device controller to control the moving device, and maintaining the transfer device in contact with the image bearing member from preceding transfer of toner image to succeeding transfer of toner image, as at least one of the areas between successive images on the image bearing member without the toner patch passes through the transfer area during continuous printing.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
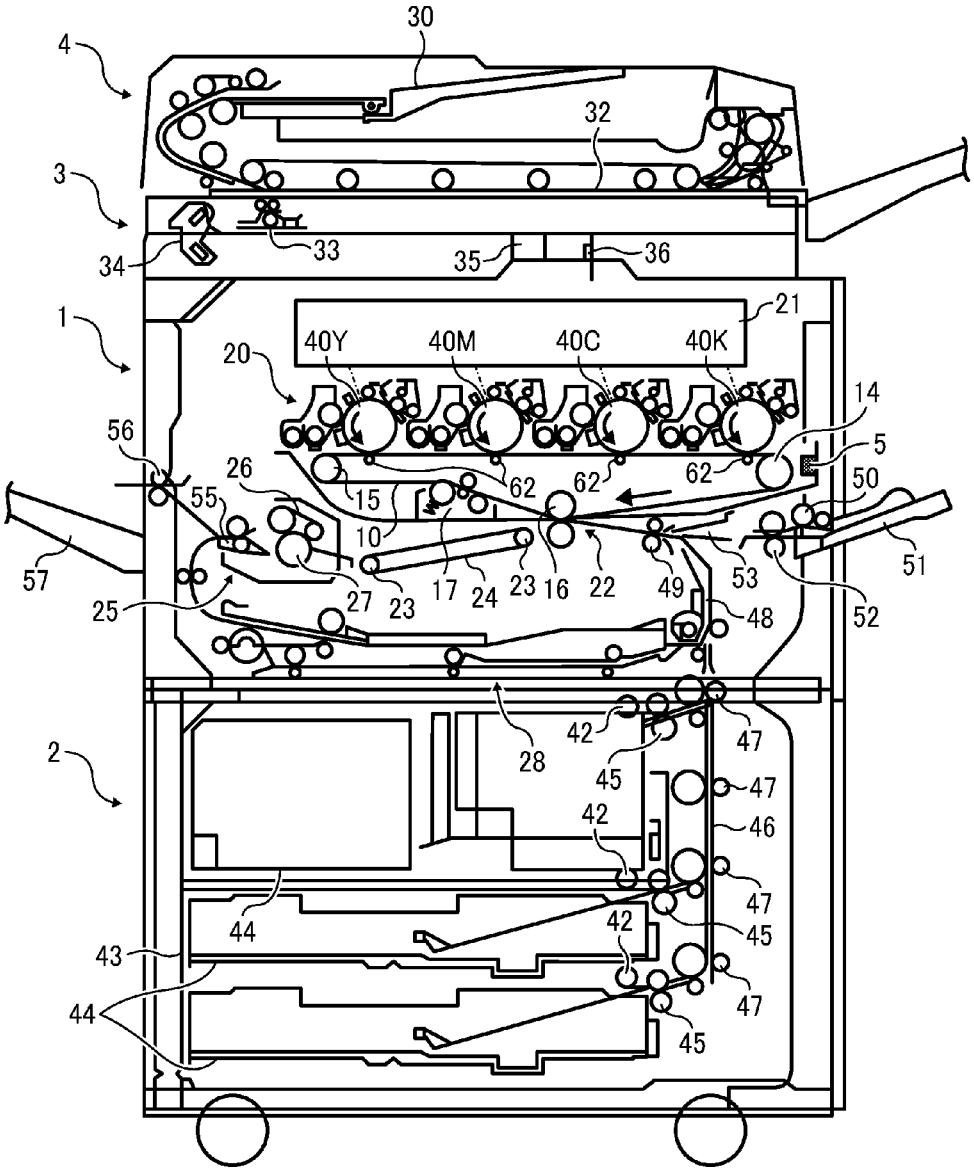
FIG. 1 is a schematic diagram illustrating a color copier as an example of an image forming apparatus according to an illustrative embodiment of the present invention.

A description is now given of illustrative embodiments of the present application. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, exemplary embodiments of the present patent application are described.

FIG. 1 is a schematic diagram illustrating a color copier as an example of the image forming apparatus. The image forming apparatus is an electrophotography image forming apparatus using an intermediate transfer method in which a toner image is transferred onto a recording medium via an intermediate transfer member.

The image forming apparatus includes a sheet feed unit 2 at the bottom thereof, a copier main body 1 disposed above the sheet feed unit 2, a scanner 3 disposed above the copier main body 1, and an automatic document feeder 4 (hereinafter referred to as ADF) disposed above the scanner 3.

As illustrated in FIG. 1, the copier main body 1 includes a transfer device 20 substantially at the center of the copier main body 1. The transfer device 20 includes an intermediate transfer belt 10 formed into an endless loop and wound around a drive roller 14, and driven rollers 15 and 16. The intermediate transfer belt 10 is stretched taut and rotates in the clockwise direction. On the right side of the driven roller 15, a cleaning device 17 is disposed to remove residual toner remaining on the surface of the intermediate transfer belt 10 after transfer in preparation for the subsequent imaging process by the transfer device 20.

Photoconductive drums 40Y, 40M, 40C, and 40K (collectively referred to as photoconductive drums 40) serving as latent image bearing members, one for each of the colors yellow, magenta, cyan, and black, are arranged above and along the intermediate transfer belt 10 in the moving direction thereof. Here, the suffixes Y, M, C, and K indicate the colors yellow, magenta, cyan, and black, respectively. To simplify the description, these suffixes are omitted herein unless otherwise specified.

Figure 2:
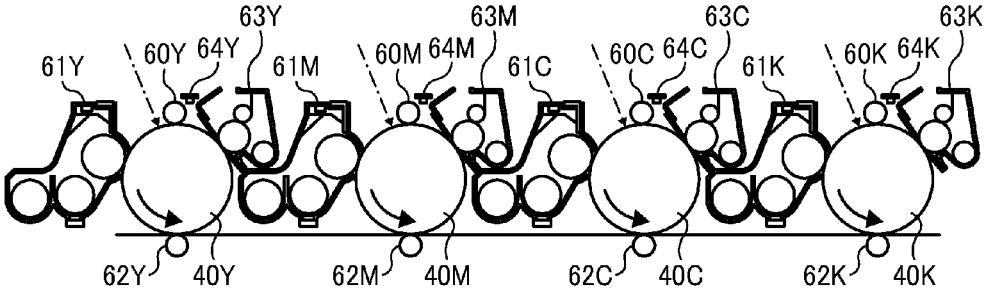
FIG. 2 is an enlarged diagram schematically illustrating transfer devices and photoconductive drums employed in the image forming apparatus of FIG. 1.

The photoconductive drums 40 rotate in the counterclockwise direction indicated by an arrow in FIG. 1. As illustrated in FIG. 2, each of the photoconductive drums 40 is surrounded by various pieces of imaging equipment, such as a charging device 60, an exposure device 21, a developing device 61, a primary transfer device 62, a drum cleaner 63, and a charge neutralizing device 64. The exposure device 21 is disposed substantially above the photoconductive drums 40.

A secondary transfer device 22 is disposed below the intermediate transfer belt 10. The secondary transfer device 22 presses against the driven roller 16 via the intermediate transfer belt 10, thereby forming a secondary transfer area therebetween. As will be described later in detail, a toner image on the intermediate transfer belt 10 is transferred onto a recording medium transported to the secondary transfer area between the secondary transfer device 22 and the intermediate transfer belt 10.

Subsequently, the recording medium bearing the toner image is carried on a conveyance belt 24 wound around a pair of rollers 23 to a fixing device 25. The fixing device 25 is disposed downstream from the secondary transfer device 22 in the direction of conveyance of the recording medium to fix the toner image on the recording medium. The fixing device 25 includes a fixing belt 26 and a pressing roller 27. The fixing belt 26 is formed into a loop and stretched taut. The pressing roller 27 presses against the fixing belt 26. A sheet reversing unit 28 is disposed substantially below the secondary transfer device 22. The sheet reversing unit 28 turns over the recording medium when an image is formed on both sides.

Still referring to FIG. 1, a description is provided of image forming operation for a color image. First, an original document is placed on a document table 30 of the ADF 4 or on a contact glass 32 of the scanner 3 by opening the ADF 4. When the document is placed on the contact glass 32, the ADF 4 is closed, pressing the document against the contact glass 32. When pressing a start button, not illustrated, of the image forming apparatus, the document in the ADF 4 is conveyed automatically to the contact glass 32. When directly placing the document on the contact glass 32, the scanner 3 is driven immediately, enabling a first carriage 33 and a second carriage 34 of the scanner 3 to start to scan the document on the contact glass 32.

A light source of the first carriage 33 projects light against the document, which is then reflected on the document. The reflected light is reflected towards the second carriage 34. A pair of mirrors of the second carriage 34 reflects the light towards a focusing lens 35 which directs the light to a read sensor 36. The read sensor 36 reads the document.

As the start button is pressed, the intermediate transfer belt 10 starts to rotate while the photoconductive drums 40 start to rotate as well. A toner image of a single color is formed on each of the photoconductive drums 40, one for each of the colors yellow, magenta, cyan, and black. The toner images on the photoconductive drums 40 are transferred onto the intermediate transfer belt 10 moving in the clockwise direction so that they are superimposed one atop the other, thereby forming a composite color toner image thereon.

As for sheet feeding operation, when the start button is pressed, one of sheet cassettes 44 of a paper bank 43 in the sheet feed unit 2 is selected, and a sheet feed rollers 42 of the respective sheet cassette 44 is rotated, thereby feeding a recording medium from a stack of recording media sheets stored in the sheet cassette 44. A sheet separation roller 45 sends the recording medium to a sheet path 46 of the sheet feed unit 2, one sheet at a time. The paper bank 43 is equipped with multiple sheet cassettes 44, each storing a stack of recording media sheets. Subsequently, the recording medium is transported to a sheet path 48 in the copier main body 1 by transport rollers 47 and stops temporarily at a pair of registration rollers 49.

In a case in which the recording medium is fed manually, a pickup roller 50 is rotated to pick up the recording medium placed on a manual feed tray 51 and sends it to a separation roller 52. The separation roller 52 then sends the recording medium to a manual feed path 53 in the copier main body 1, one sheet at a time. The recording medium is stopped temporarily by the pair of registration rollers 49.

In either cases, when rotation of the pair of registration rollers 49 resumes, the recording medium is sent to a secondary transfer area between the intermediate transfer belt 10 and the secondary transfer device 22 in appropriate timing such that the recording medium is aligned with a composite color toner image formed on the intermediate transfer belt 10. Then, the composite color toner image on the intermediate transfer belt 10 is transferred onto a recording medium by the secondary transfer device 22. The recording medium on which the composite color toner image has been transferred is carried on the conveyance belt 24 to the fixing device 25. In the fixing device 25, heat and pressure are applied to the recording medium so that the composite color toner image is fixed on the recording medium. After fixing, the recording medium is directed to a sheet discharge tray 57 by a switching claw 55 and discharged onto the tray 57 by discharge rollers 56.

In a case in which images are formed on both sides of the recording medium, the switching claw 55 directs the recording medium to the reversing unit 28 in which the recording medium is turned over so that an image is formed on the other side. After the image is formed, the recording medium is discharged by the discharge rollers 56 onto the sheet discharge tray 57.

For forming a single color image, for example, when forming an image in the color black, the photoconductive drums 40Y, 40M, and 40C are separated from the intermediate transfer belt 10 by moving the driven rollers 15 and 16 so that only the photoconductive drum 40K remains in contact with the intermediate transfer belt 10. Accordingly, the toner image in the color black is formed on the photoconductive drum 40K. It is to be noted that, in general, in an image forming apparatus having only one photoconductive drum, an image in the color black is produced first so that the copy speed of an initial copy is fast. After producing the black image, imaging operation for the remaining colors is performed if the document contains multiple colors.

Generally, the registration rollers 49 are grounded. Alternatively, however, in order to remove paper dust, the registration rollers 49 may be electrically biased. For example, when supplying a bias using a conductive rubber roller with a diameter of 18 mm having a surface coated with a conductive NBR rubber with a thickness of 1 mm, the volume resistivity of the rubber material is approximately $10^9$ Ω·cm. A voltage of approximately −800V is supplied to the front surface of the recording medium on which the toner image is transferred. A voltage of approximately +200V is supplied to the rear surface of the recording medium. In general, in the intermediate transfer method, paper dust is difficult to move to the photoconductive drum so that the registration rollers may be grounded.

When supplying a bias to the registration rollers, generally, a DC bias is supplied. Alternatively, in order to charge the recording medium uniformly, an AC voltage having a DC offset component may be supplied. The recording medium passing through the registration rollers supplied with the bias is negatively charged slightly. Thus, when the toner image is transferred from the intermediate transfer belt 10 to the recording medium, transfer conditions may be changed as compared with supplying no voltage to the registration rollers.

According to the illustrative embodiment, the image forming apparatus includes a toner detector 5 to detect an amount of toner (density of toner) adhered to the intermediate transfer belt 10. The toner detector 5 employs an infrared emitting diode for a light emitting portion and a photodiode for a diffuse reflection light receiving portion. The toner detector 5 outputs a voltage in accordance with an amount of received light.

Figure 3:
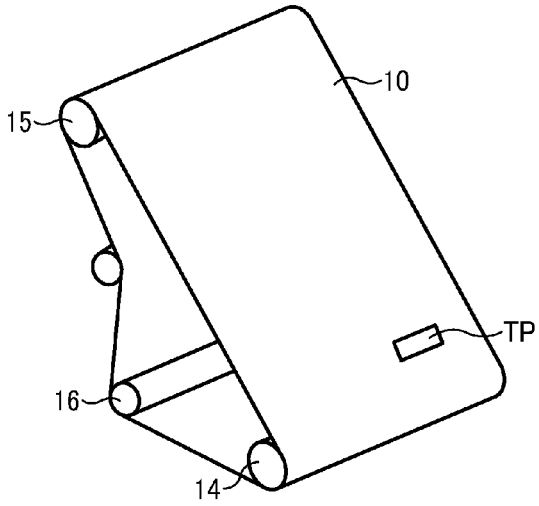
FIG. 3 is a perspective view schematically illustrating an intermediate transfer belt and a toner patch formed thereon for adjustment of toner density.

With reference to FIG. 3, a description is provided of detection of a toner patch TP. FIG. 3 is a perspective view schematically illustrating the intermediate transfer belt 10 and a toner patch TP for adjustment of the density of toner formed on the intermediate transfer belt 10. The toner patch TP is a test image used to achieve a target toner density for an output image and hence is not transferred onto a recording medium. The toner patch TP is formed initially on the photoconductive drum 40 and then transferred onto the intermediate transfer belt 10 by the primary transfer device 62 at a primary transfer area where the photoconductive drum 40 contacts the intermediate transfer belt 10.

In general, a plurality of toner patches TP is formed for each color and for different target densities. The amount of toner adhered to each toner patch TP (density of toner) is detected by the toner detector 5 disposed across from the intermediate transfer belt 10. The toner patch TP is formed and detected in a process control mode (density adjustment mode) which is different from actual imaging operation. Alternatively, the toner patch TP is formed and detected at specific times, such as between successive toner images on the intermediate transfer belt 10 (successive recording media sheets) during continuous imaging operation (during continuous printing).

Figure 4:
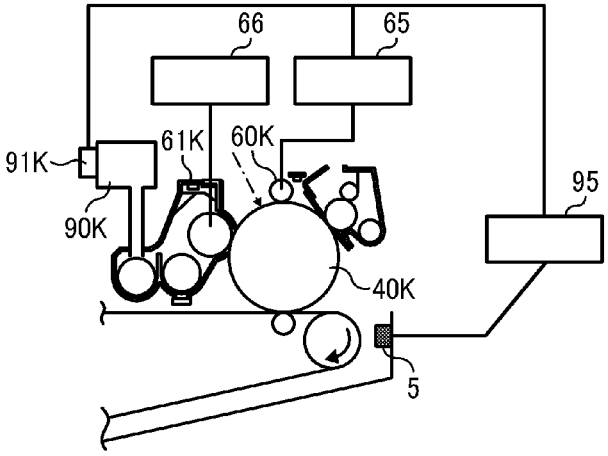
FIG. 4 is a partially enlarged diagram schematically illustrating the photoconductive drum and a density adjustment controller.

With reference to FIG. 4, a description is provided of adjustment of image density, also referred to as a toner density, for the color black, as a representative example of the adjustment of image density. Although not illustrated, the density of toner for cyan, magenta, and yellow is adjusted in the same manner. FIG. 4 is a partially enlarged diagram schematically illustrating the photoconductive drum 40K and a density adjustment controller 95.

As described above, the toner detector 5 detects an amount of toner adhered to the toner batch. Based on the result detected by the toner detector 5, the density adjustment controller 95 controls at least one of a toner supply motor 91K of a toner supply unit 90K, a developing bias applicator 66, and a charging bias applicator 65 to adjust a density of an image. When adjusting the density of an image using the toner supply motor 91K, the density of toner is adjusted by changing an amount of toner supply. When adjusting the density of an image using the developing bias applicator and the charging bias applicator, the density of toner is adjusted by changing an amount of bias.

Embodiment 1

Figure 5A:
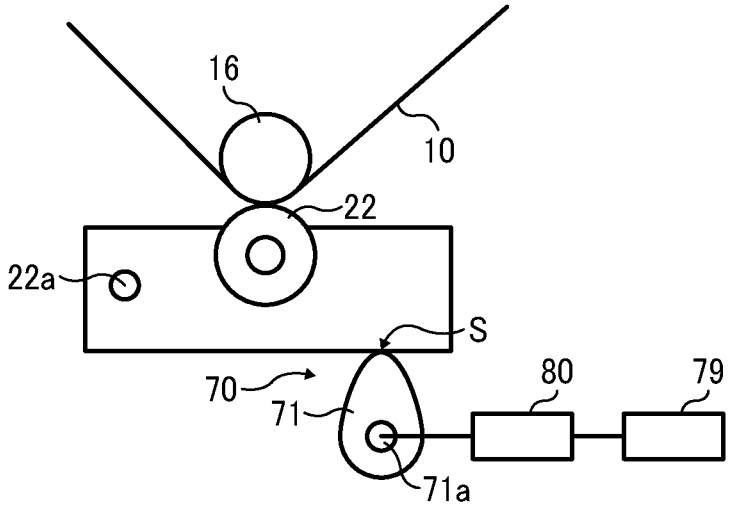
FIG. 5A is a schematic diagram illustrating a moving device for moving a secondary transfer device when the secondary transfer device is in contact with the intermediate transfer belt according to a first illustrative embodiment of the present invention.
Figure 5B:
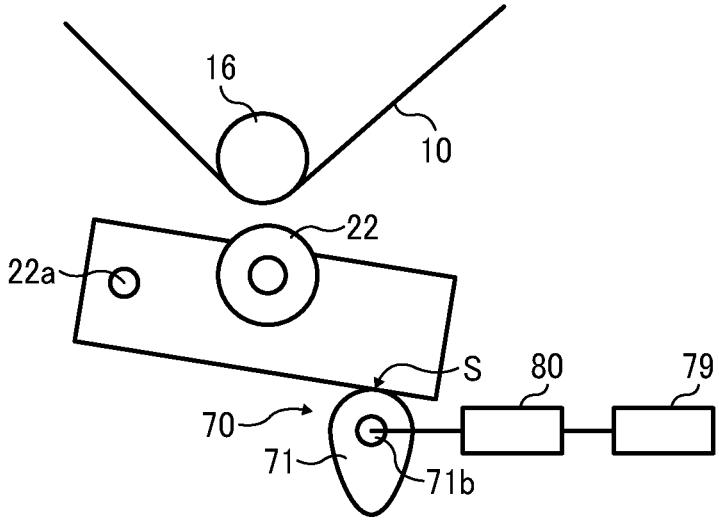
FIG. 5B is a schematic diagram illustrating the moving device when the secondary transfer device is separated from the intermediate transfer belt according to the first illustrative embodiment.

With reference to FIGS. 5A and 5B, a description is provided of a moving device 70 that moves the secondary transfer device 22 relative to the intermediate transfer belt 10 according to a first illustrative embodiment.

FIG. 5A is a schematic diagram illustrating the secondary transfer device 22, the intermediate transfer belt 10, and the moving device 70 when the secondary transfer device 22 is in contact with the intermediate transfer belt 10. FIG. 5B is a schematic diagram illustrating the secondary transfer device 22, the intermediate transfer belt 10, and the moving device 70 when the secondary transfer device 22 is separated from the intermediate transfer belt 10.

As illustrated in FIG. 5A, the moving device 70 includes a cam 71, a rotation shaft 71*a*, and a driving device 80 (i.e. a motor) connected to the rotation shaft 71*a* to rotate the cam 71. The driving device 80 is controlled by a controller 79.

The cam 71 is disposed such that the cam surface thereof contacts a contact position S of the secondary transfer device 22. According to the present embodiment, as illustrated in FIG. 5A, as the cam surface farthest from the rotation shaft 71*a* of the cam 71 contacts the contact position S of the secondary transfer device 22, the secondary transfer device 22 contacts the intermediate transfer belt 10.

By contrast, as illustrated in FIG. 5B, as the cam surface nearest from the rotation shaft 71*a* of the cam 71 contacts the contact position S of the secondary transfer device 22, that is, the cam 71 is rotated 180 degrees from the position illustrated in FIG. 5A, the secondary transfer device 22 is separated from the intermediate transfer belt 10. When the secondary transfer device 22 is in contact with the intermediate transfer belt 10 and the cam 71 is rotated, the secondary transfer device 22 remains contacting the cam surface of the cam 71 under its own weight. With this configuration, as illustrated in FIG. 5B, the secondary transfer device 22 rotates about a rotation shaft 22*a* in the clockwise direction, separating from the intermediate transfer belt 10.

Figure 6:
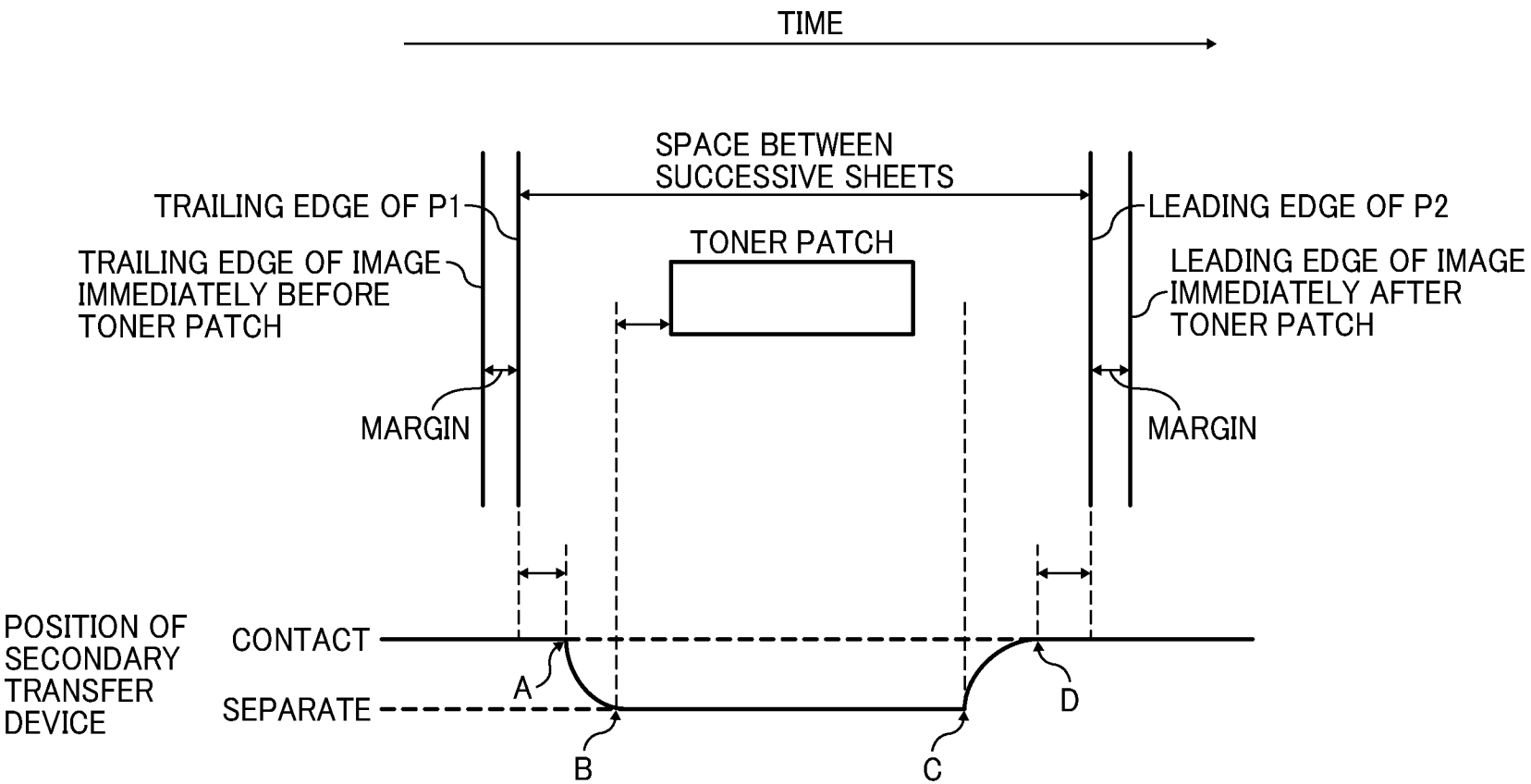
FIG. 6 is a timing chart showing control of movement of the secondary transfer device according to the first illustrative embodiment.

With reference to FIG. 6, a description is provided of timing of separation of the secondary transfer device 22 from the intermediate transfer belt 10 in relation to timing at which a recording medium P, a toner image, and a toner patch TP pass through the secondary transfer area. FIG. 6 is a timing chart showing control of movement of the secondary transfer device 22.

In EMBODIMENT 1, the toner patch TP is formed between successive toner images on the intermediate transfer belt 10 and detected at a specific time during continuous printing, thereby adjusting the density of toner. This process is also known as process control (density adjustment control). As the toner patch TP formed on the intermediate transfer belt 10 passes through the secondary transfer area, there is no recording medium in the secondary transfer area. If the secondary transfer device 22 is in contact with the intermediate transfer belt 10, the toner patch TP contacts the secondary transfer device 22 and sticks thereto. The toner adhered undesirably to the secondary transfer device 22 sticks to the recording medium P being transported to the secondary transfer area, thereby contaminating the rear surface of the recording medium.

To address such difficulty, the cam 71 is driven by the driving device 80 controlled by the controller 79 serving as a moving device controller so that while the toner patch TP passes through the transfer area (non-transfer toner passing period), the secondary transfer device 22 is separated from the intermediate transfer belt 10. The non-transfer toner refers to toner that is not used in an image and hence not transferred onto a recording medium.

More specifically, as illustrated in FIG. 5A, the secondary transfer device 22 contacts the intermediate transfer belt 10, and the toner image immediately before forming the toner patch TP is transferred secondarily onto a preceding recording medium P1 in the secondary transfer area. After the trailing edge of the preceding recoding medium P1 passes through the secondary transfer area, the controller 79 enables the driving device 80 of the cam 71 to rotate the cam 71 (Arrow A in FIG. 6).

The cam 71 starts to rotate at a specific time such that the cam 71 completes its half-turn so that the secondary transfer device 22 separates from the intermediate transfer belt 10 as illustrated in FIG. 5B before the leading edge of the toner patch TP enters the secondary transfer area (Arrow B in FIG. 6).

After the trailing edge of toner patch TP passes through the secondary transfer area, the controller 79 enables the driving device 80 of the cam 71 to rotate the cam 71 (Arrow C in FIG. 6). The cam 71 starts to rotate at a specific time such that the cam 71 completes its half-turn so that the secondary transfer device 22 contacts the intermediate transfer belt 10 as illustrated in FIG. 5A before the leading edge of a succeeding recording medium P2 enters the secondary transfer area (Arrow D in FIG. 6).

Embodiment 2

Figure 7A:
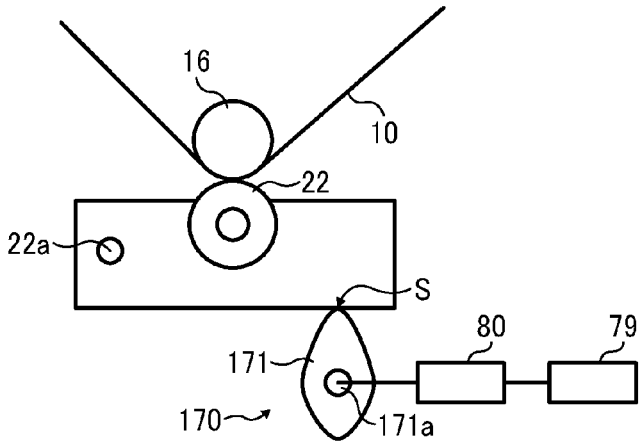
FIG. 7A is a schematic diagram illustrating another example of the moving device when the secondary transfer device is in contact with the intermediate transfer belt according to a second illustrative embodiment of the present invention.
Figure 7B:
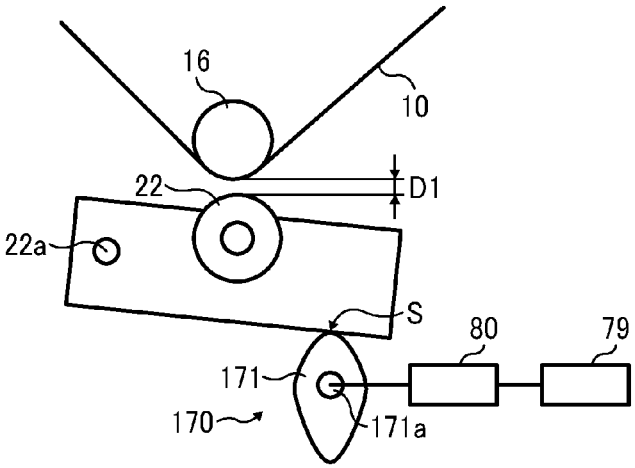
FIG. 7B is a schematic diagram illustrating the moving device when the secondary transfer device is in a first separation state according to the second illustrative embodiment.
Figure 7C:
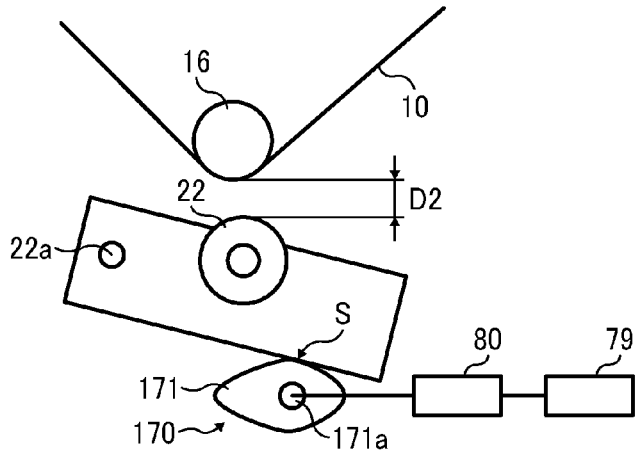
FIG. 7C is a schematic diagram illustrating the moving device when the secondary transfer device is in a second separation state according to the second illustrative embodiment.

With reference to FIGS. 7A through 7C, a description is provided of another example of the moving device that moves the secondary transfer device 22 according to a second illustrative embodiment.

FIG. 7A is a schematic diagram illustrating a moving device 170 when the secondary transfer device 22 is in contact with the intermediate transfer belt 10. FIG. 7B is a schematic diagram illustrating the moving device 170 when the secondary transfer device 22 is in a first separation state. FIG. 7C is a schematic diagram illustrating the moving device 170 when the secondary transfer device 22 is in a second separation state.

The moving device 170 includes a cam 171, a rotation shaft 171*a* connected to the driving device 80. The cam 171 rotates about the rotation shaft 171*a* driven by the driving device 80. Similar to the first illustrative embodiment, the cam 171 of the moving device 170 rotates so that the secondary transfer device 22 separates from and contact the intermediate transfer belt 10. However, according to the second illustrative embodiment, the cam 171 allows the secondary transfer device 22 to take a plurality of separation positions, here, two separation positions, so that different distances D1 and D2 are obtained between the secondary transfer device 22 and the intermediate transfer belt 10.

More specifically, as illustrated in FIG. 7A, as the cam surface farthest from the rotation shaft 171*a* of the cam 171 contacts the contact position S of the secondary transfer device 22, the secondary transfer device 22 contacts the intermediate transfer belt 10. As illustrated in FIG. 7B, when the cam 171 makes a half-turn (rotated by 180 degrees) from the position shown in FIG. 7A, the secondary transfer device 22 separates from the intermediate transfer belt 10, obtaining the distance D1 between the secondary transfer device 22 and the intermediate transfer belt 10 (First separation state).

As the cam 171 is rotated by 90 degrees from the position illustrated in FIG. 7A in which the secondary transfer device 22 is in contact with the intermediate transfer belt 10, the secondary transfer device 22 separates from intermediate transfer belt 10 as illustrated in FIG. 7C, obtaining the distance D2 between the secondary transfer device 22 and the intermediate transfer belt 10 (Second separation state). The distance between the cam surface of the cam 171 which contacts the contact position S of the secondary transfer device 22 and the rotation shaft 71*a* in the first separation state is longer than the distance between the cam surface of the cam 171 which contacts the contact position S of the secondary transfer device 22 and the rotation shaft 71*a* in the second separation state. With this configuration, the distance D1 when the secondary transfer device 22 is in the first separation state is shorter than the distance D2 when the secondary transfer device 22 is in the second separation state.

According to the second embodiment, the position of the secondary transfer device 22 can be changed from any one of the positions shown in FIGS. 7A through 7C to any one of the positions shown in FIGS. 7A through 7C. It is to be noted that the shape of the cam is not limited to the foregoing embodiments shown in the drawings. Any other suitable shape may be implemented.

Embodiment 3

Figure 8A:
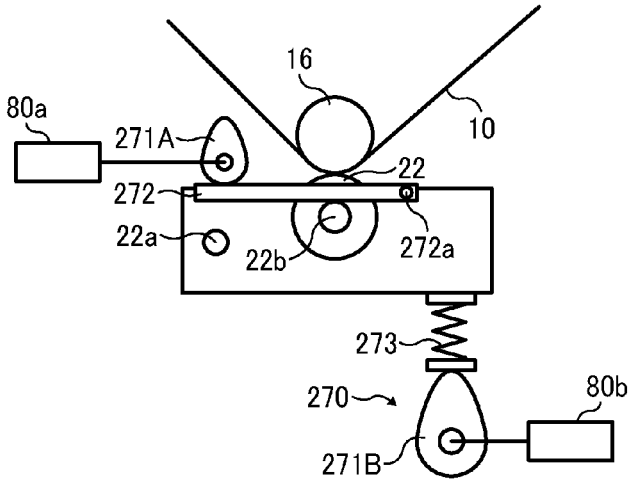
FIG. 8A is a schematic diagram illustrating another example of the moving device when the secondary transfer device is in contact with the intermediate transfer belt according to a third illustrative embodiment of the present invention.
Figure 8B:
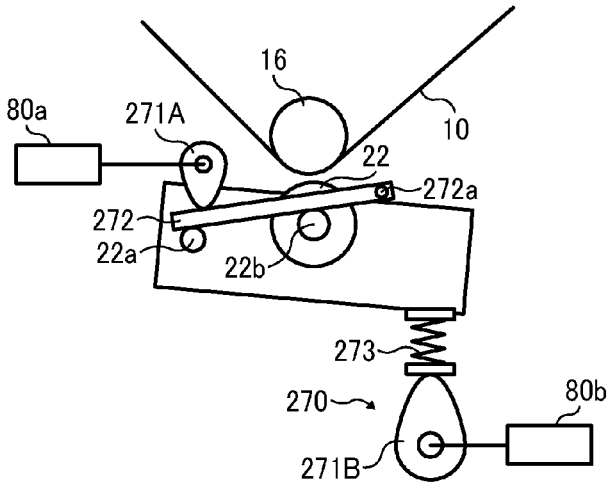
FIG. 8B is a schematic diagram illustrating the moving device when the secondary transfer device is in a first separation state according to the third illustrative embodiment.
Figure 8C:
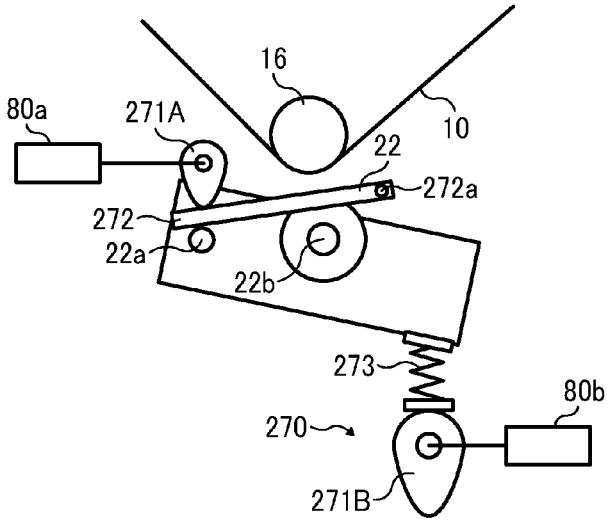
FIG. 8C is a schematic diagram illustrating the moving device when the secondary transfer device is in a second separation state according to the third illustrative embodiment.

With reference to FIGS. 8A through 8C, a description is provided of another example of the moving device that moves the secondary transfer device 22 according to a third illustrative embodiment.

FIG. 8A is a schematic diagram illustrating a moving device 270 when the secondary transfer device 22 is in contact with the intermediate transfer belt 10. FIG. 8B is a schematic diagram illustrating the moving device 270 when the secondary transfer device 22 is in the first separation state. FIG. 8C is a schematic diagram illustrating the moving device 270 when the secondary transfer device 22 is in the second separation state.

According to the third illustrative embodiment, similar to the second illustrative embodiment, the moving device 270 allows the secondary transfer device 22 to take a plurality of separation positions, here, two separation positions, so that different distances are obtained between the secondary transfer device 22 and the intermediate transfer belt 10. The moving device 270 includes a first cam 271A, a second cam 271B, an arm 272, a compression spring 273, driving devices 80*a* and 80*b* connected to the first cam 271A and the second cam 271B, respectively. In the third illustrative embodiment, the first cam 271A and the second cam 271B move to change the position of the secondary transfer device 22.

As illustrated in FIG. 8A, the first cam 271A is disposed above the left side of the arm 272 to contact substantially the edge portion of the arm 272 from above. The arm 272 is swingably movable about a fulcrum point 272*a* at the other end of the arm 272, that is, the right end portion of the arm 272. An end portion of a roller shaft 22*b* of the secondary transfer device 22 contacts substantially the center of the arm 272 from the bottom of the arm 272.

As the first cam 271A rotates, pressing down the arm 272, the arm 272 rotates downward about the fulcrum point 272*a* so that the end portion of the roller shaft 22*b* of the secondary transfer device 22 is pressed down. Accordingly, the secondary transfer device 22 separates from the intermediate transfer belt 10.

The second cam 271B is disposed below the secondary transfer device 22 via the compression spring 273 to press the bottom of the secondary transfer device 22. The secondary transfer device 22 is always pressed upward by the compression spring 273. With this configuration, the arm 272 is always biased upward by the roller shaft 22*b* of the secondary transfer device 22 so that the arm 272 remains in contact with the cam surface of the first cam 271A.

As illustrated in FIG. 8B, when the driving device 80*a* (first motor) controlled by the controller 79 enables the first cam 271A to make a half-turn from the position shown in FIG. 8A in which the secondary transfer device 22 is in contact with the intermediate transfer belt 10, the left end portion of the arm 272 is pressed down by the first cam 271A, pressing down the roller shaft 22*b*. Accordingly, as illustrated in FIG. 8B, the secondary transfer device 22 separates from the intermediate transfer belt 10, that is, the secondary transfer device 22 is in the first separation state. The roller shaft 22*b* of the secondary transfer device 22 biased upward by the compression spring 273 contacts the arm 272 so that the secondary transfer device 22 in the vertical direction is positioned in place as illustrated in FIG. 8B.

Based on an instruction from the controller 79, as the driving device 80*b* (second motor) enables the second cam 271B to make a half-turn from the first separation state as illustrated in FIG. 8B, the bottom end of the compression spring 273 is lowered, reducing an amount of compression of the compression spring 273 and hence reducing a pressure to move the secondary transfer device 22 upward. As a result, under its own weight of the secondary transfer device 22, the upper end of the compression spring 273 is lowered, and as illustrated in FIG. 8C, the secondary transfer device 22 is positioned at a place at which the weight of the secondary transfer device itself and the pressing force of the compression spring 273 are balanced. Accordingly, the distance between the secondary transfer device 22 and the intermediate transfer belt 10 in the second separation state is longer than the distance therebetween in the first separation state.

Figure 9:
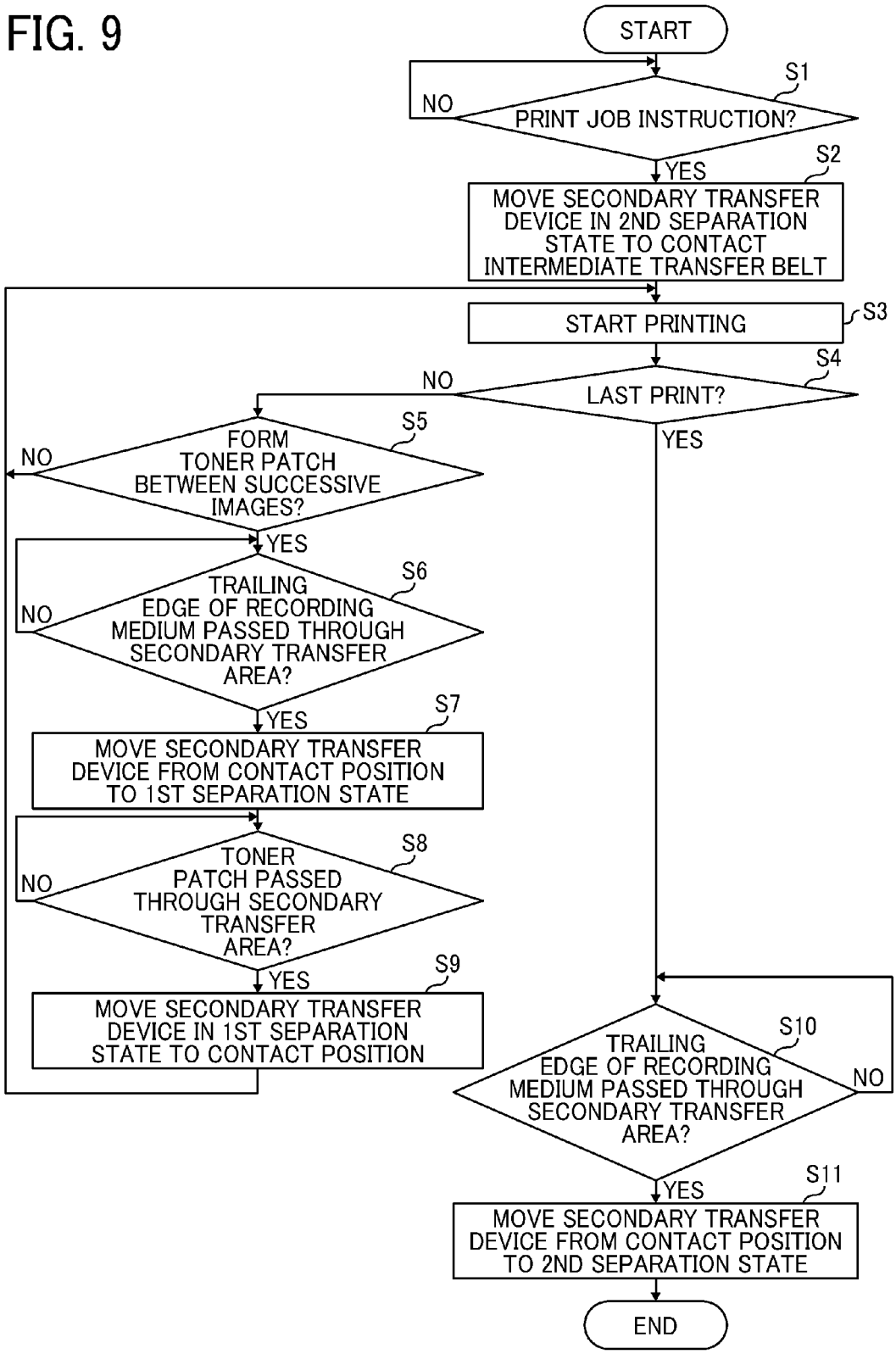
FIG. 9 is a flowchart showing steps in control of movement of the secondary transfer device.

With reference to FIG. 9, a description is provided of an example control of movement of the secondary transfer device 22. FIG. 9 is a flowchart showing steps in control of movement of the secondary transfer device 22. The flowchart shown in FIG. 9 shows the control steps for the moving device 170 of the second illustrative embodiment. However, the basic control steps are the same for the moving device of the first and the third illustrative embodiments.

As illustrated in FIG. 9, when the controller 79 receives a print job at Step S1 (YES, S1), the cam 171 is rotated by 90 degrees before the recording medium P enters the secondary transfer area so that the secondary transfer device 22 moves from the second separation state shown in FIG. 7C to the contact state shown in FIG. 7A at Step S2. Subsequently, at Step S3, printing operation for the recording medium P is initiated. If it is the last printing operation, that is, there is no more image to print at Step S4 (YES, S4), the cam 171 is rotated in an opposite direction by 90 degrees after the trailing edge of the recording medium P passes through the secondary transfer area at Step S10. Accordingly, the secondary transfer device 22 contacting the intermediate transfer belt 10 as illustrated in FIG. 7A separates from the intermediate transfer belt 10 as illustrated in FIG. 7C which is the second separation state at Step S11.

By contrast, if there are more images to print (NO, S4), whether or not a toner patch needs to be formed between the preceding image being printed and the succeeding image is verified at Step S5. If the toner patch is not formed (NO, S5), the printing operation for the succeeding image is initiated at a predetermined time as usual. At this time, the secondary transfer device 22 remains in contact with the intermediate transfer belt 10 while the area between the image being printed and the succeeding image, that is, between the successive images, passes through the secondary transfer area.

With this configuration, the time during which the area between the successive images passes through the secondary transfer area does not depend on the moving speed of the moving device, thereby reducing the time as much as possible.

If the toner patch is formed between the preceding image and the succeeding image (YES, S5), the cam 171 is rotated by 180 degrees after the trailing edge of the recording medium P passes through the secondary transfer area at Step S6, but before the toner patch TP enters the secondary transfer area. Accordingly, the secondary transfer device 22 contacting the intermediate transfer belt 10 as shown in FIG. 7A separates from the intermediate transfer belt 10 as illustrated in FIG. 7B at Step S7.

Subsequently, the cam 171 is rotated in the opposite direction by 180 degrees after the trailing edge of the toner patch TP passes through the secondary transfer area at Step S8, but before the next recording medium enters the secondary transfer area. Accordingly, the secondary transfer device 22 moves from the first separation state shown in FIG. 7B to the contact position shown in FIG. 7A at Step S9.

Subsequently, the printing operation for the subsequent image is initiated at a predetermined time. The secondary transfer device 22 remains in contact with the intermediate transfer belt 10 while the toner patch TP formed in the area between the image being printed and the succeeding image (between successive images) passes through the secondary transfer area. With this configuration, the toner patch TP is prevented from contacting the secondary transfer device 22, hence preventing contamination of the rear surface of the subsequent recording medium with toner of the toner patch TP via the secondary transfer device 22.

According to the illustrative embodiments described above, the toner patch TP that is not to be transferred onto the recording medium is formed in the area between successive toner images on the intermediate transfer belt 10 during continuous printing in which an image is formed continuously on more than 2 recording media sheets. During continuous printing, the controller 79 controls the moving device (70, 170, and 270) such that the secondary transfer device 22 is in contact with the intermediate transfer belt 10 during transfer of the toner image on the intermediate transfer belt 10 to the recording medium. The secondary transfer device 22 is separated from the intermediate transfer belt 10 as the toner patch TP passes through the secondary transfer area. With this configuration, the secondary transfer device 22 does not get contaminated by the toner in the toner patch TP, thereby preventing contamination of the rear side of the recording medium with the toner.

According to the illustrative embodiments, the controller 79 controls the moving device (70, 170, 270) such that during continuous printing when at least one of no-image areas between successive images on the intermediate transfer belt 10 passes through the secondary transfer area, the moving device (70, 170, 270) does not move so that the secondary transfer device 22 and the intermediate transfer belt 10 remain in contact with one another for a certain time period, such as between the time immediately before transfer of an image and immediately after transfer of the image.

With this configuration, during continuous printing, for the area between successive images on the intermediate transfer belt 10 contacting the secondary transfer device 22, the speed of this area passing through the transfer area does not depend on the speed of the movement of the secondary transfer device 22 separating from and contacting the intermediate transfer belt 10. Accordingly, the speed of the area between successive images on the intermediate transfer belt 10 passing through the transfer area can be shortened. As compared with the related-art image forming apparatus in which the speed of the area between successive images on the intermediate transfer belt passing through the transfer nip depends significantly on the speed of movement of the secondary transfer device, the present invention can reduce the total time for continuous printing, thereby increasing productivity.

According to the illustrative embodiments described above, the time during which the area between the successive images at which the secondary transfer device 22 contacts the intermediate transfer belt 10 passes through the transfer area is shorter than the time during which the area with the toner patch TP between the successive images passes. With this configuration, the total time for continuous printing is reduced, thereby increasing productivity.

According to EMBODIMENT 2 and EMBODIMENT 3, the moving devices 170 and 270 allow the secondary transfer device 22 to take the plurality of separation positions, here, two separation positions, so that different distances D1 and D2 are obtained between the secondary transfer device 22 and the intermediate transfer belt 10. The moving devices 170 and 270 controlled by the controller 79 can move the secondary transfer device 22 at a specific time other than during continuous printing.

More specifically, the moving devices 170 and 270 can move the secondary transfer device 22 to separate from and contact the intermediate transfer belt 10 immediately after continuous printing. When the secondary transfer device 22 is separated from the intermediate transfer belt 10 while the toner patch TP passes through the secondary transfer area, the controller 79 moves the moving devices 170 and 270 such that the distance between the secondary transfer device 22 and the intermediate transfer belt 10 is shorter than the distance immediately after the completion of continuous printing. Because the distance between the secondary transfer device 22 and the intermediate transfer belt 10 is shorter when the toner patch TP passes through the transfer area during continuous printing, the secondary transfer device 22 can quickly move back to its contact position at which the secondary transfer device 22 contacts the intermediate transfer belt 10.

The total time for continuous printing operation can be reduced, hence increasing productivity. Furthermore, according to the illustrative embodiments, in order to replace the degraded toner in the developing device 61 with new toner, immediately after completion of continuous printing, the degraded toner in the developing device 61 is forcibly discharged to the photoconductive drum 40 and then transferred onto the intermediate transfer belt 10. The degraded toner on the intermediate transfer belt 10 is removed and recovered by the cleaning device 17.

Here, the amount of waste toner adhered to the intermediate transfer belt 10 is more than the amount of toner adhered to the toner patch TP. In this case, if the distance between the secondary transfer device 22 and the intermediate transfer belt 10 while the waste toner on the intermediate transfer belt 10 passes through the transfer area is as short as that of when the toner patch TP passes through the transfer area, the waste toner may stick to the secondary transfer device 22.

In view of the above, according to EMBODIMENT 2 and EMBODIMENT 3, the waste toner immediately after completion of continuous printing is prevented from adhering to the secondary transfer device 22 without degrading the moving speed of the secondary transfer device 22 and contamination of the secondary transfer device 22 by toner of the toner patch TP.

According to EMBODIMENT 2 and EMBODIMENT 3, the secondary transfer device 22 can contact the intermediate transfer belt 10 from the first separation state or the second separation state using a single operation with a simple configuration. Furthermore, the secondary transfer device 22 contacting the intermediate transfer belt 10 can move to the first separation position or the second separation position with a single operation using a simple configuration. That is, using the moving device 170 and 270, the secondary transfer device 22 can change its position easily.

According to the illustrative embodiments, when using a relatively thick recording medium, before the leading edge of the recording medium enters the secondary transfer area, the secondary transfer device 22 is moved to the same separation position as the position when the toner patch TP passes through the transfer nip. After the leading edge of the recording medium enters the secondary transfer area, the secondary transfer device 22 contacts the intermediate transfer belt 10.

When the secondary transfer device 22 is in contact with the intermediate transfer belt 10 and the leading edge of the recording medium having a strong resilience, such as a thick recording medium, enters the secondary transfer area, the leading edge thereof strikes the secondary transfer device 22 and the intermediate transfer belt 10, generating significant vibration. The vibration travels to the intermediate transfer belt 10, thus degrading imaging quality. In view of the above, when the thick recording medium enters the secondary transfer area, the secondary transfer device 22 is separated from the intermediate transfer belt 10 so that the leading edge of the recording medium does not strike the secondary transfer area, preventing undesirable vibration and hence degradation of imaging quality.

According to the illustrative embodiments, a plurality of toner patches TP is formed on the photoconductive drums 40Y, 40M, 40C, and 40K, one for each of the colors yellow, magenta, cyan, and black, and transferred at the same area between successive images on the intermediate transfer belt 10 so that the number of areas in which the toner patches are formed is reduced during continuous printing. In other words, reduction of the areas at which the toner patches are formed can reduce the time during which the toner patch passes through the transfer nip and hence productivity can be increased during continuous printing.

Preferably, the toner detector 5 may be provided for each color to detect the toner patches individually. If a single toner detector detects the plurality of toner patches, the toner patches need to be aligned within a detectable area by the detector in the direction of rotation of the intermediate transfer belt 10. In such a case, the length of the area between the successive images in the direction of rotation of the intermediate transfer belt where the toner patches are formed needs to be long. As a result, the time during which the toner patches pass through the transfer nip takes long, degrading productivity.

By contrast, if each of the plurality of toner patches is detected by a respective one of the toner detectors 5, the toner patches can be arranged in the width direction of the intermediate transfer belt 10 perpendicular to the direction of rotation of the intermediate transfer belt 10 such that the toner patterns pass through the area detectable by the toner detectors 5. With this configuration, the distance between successive images in the direction of rotation of the intermediate transfer belt is reduced, hence increasing productivity, as compared with using a single toner detector to detect the plurality of toner patterns.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image based on image information on a surface thereof;

a transfer device disposed opposite the image bearing member to form a transfer area there between to transfer the toner image onto a recording medium in the transfer area;

a sheet transport device to transport the recording medium to the transfer area;

a moving device coupled to the transfer device to move the transfer device to alternately separate from and contact the image bearing member, the moving device moving the transfer device to contact the image bearing member when the toner image is transferred onto the recording medium;

a toner patch forming device to form a toner patch comprising toner not to be transferred onto the recording medium between successive toner images during continuous printing; and a moving device controller operatively connected to the moving device to control the moving device, such that the moving device:

moves the transfer device to contact the image bearing member during transfer of the toner image on the image bearing member to the recording medium;

separates the transfer device from the image bearing member as the toner patch on the image bearing member passes through the transfer area; and maintains the transfer device in contact with the image bearing member from a preceding transfer of a toner image to a succeeding transfer of a toner image during continuous printing, as at least one of areas between successive toner images on the image bearing member without the toner patch passes through the transfer area, wherein the moving device moves the transfer member to one of at least two different separation positions as the transfer member is separated from the image bearing member, wherein the moving device controller controls the moving device to move the transfer device to one of the at least two different separation positions during a time other than continuous printing, and wherein as the toner patch passes through the transfer area and the transfer member is separated from the image bearing member, a first distance between the transfer device and the image bearing member at a first separation position when the toner patch passes through the transfer area is shorter than a second distance at a second separation position different from the first separation positions.

2. The image forming apparatus according to claim 1, wherein a time during which the at least one of the areas between successive toner images on the image bearing member passes through the transfer area while the transfer member remains in contact with the image bearing member is shorter than a time during which the area with the toner patch passes through the transfer area.

3. The image forming apparatus according to claim 1, wherein the moving device moves the transfer device from any one of the separation positions to contact the image bearing member with a single operation, and the moving device separates the transfer device from the image bearing member to any one of the separation positions with a single operation.

4. The image forming apparatus according to claim 3, wherein the moving device comprises a cam to contact the transfer device and a driving device to rotate the cam.

5. The image forming apparatus according to claim 3, wherein when forming an image on a recording medium, before the leading edge of the recording medium enters the transfer area, the moving device controller controls the moving device to move the transfer device to the same separation position as the position when the toner patch passes through the transfer area, and the moving device moves the transfer device to contact the image bearing member after the leading edge of the recording medium enters the transfer area.

6. The image forming apparatus according to claim 1, wherein the toner patch forming device comprises:

a toner detector to detect an amount of toner adhered to the toner patch; and a density adjustment controller to adjust a density of an image based on a result detected by the toner detector, wherein the toner patch comprises toner not to be transferred onto the recording medium for adjustment of a density of toner on the image bearing member.

7. The image forming apparatus according to claim 6, further comprising:

a plurality of latent image bearing members to bear a latent image formed on a surface thereof;

a developing device to develop the latent images formed on the plurality of latent image bearing members using toner to form toner images; and a primary transfer device to transfer and superimpose the toner images one atop the other onto an intermediate transfer member to form a composite toner image, wherein the transfer device transfers the composite toner image on the intermediate transfer member onto a recording medium, wherein the toner pattern forming device forms the toner pattern on each of the plurality of latent image bearing members and transfers the toner patterns onto the same area between the successive toner images on the intermediate transfer member.

8. The image forming apparatus according to claim 7, wherein the toner detector comprises a plurality of the toner detectors to detect independently the toner patterns formed on the plurality of latent image bearing members.

9. A toner density control method for use in an image forming apparatus, the image forming apparatus comprising:

an image bearing member to bear a toner image based on image information on a surface thereof;

a transfer device disposed opposite the image bearing member to form a transfer area therebetween to transfer the toner image onto a recording medium in the transfer area;

a sheet transport device to transport the recording medium to the transfer area;

a moving device coupled to the transfer device to move the transfer device to separate from and contact the image bearing member, the moving device moving the transfer device to contact the image bearing member when the toner image is transferred onto the recording medium;

a toner patch forming device to form a toner patch comprising toner not to be transferred onto the recording medium for adjustment of a density of toner at a place on the image bearing member between successive toner images during continuous printing; and a moving device controller operatively connected to the moving device to control movement of the moving device, the method comprising:

moving the transfer device to contact the image bearing member during transfer of the toner image on the image bearing member onto the recording medium using the moving device controller to control the moving device;

separating the transfer device from the image bearing member as the toner patch on the image bearing member passes through the transfer area using the moving device controller to control the moving device;

maintaining the transfer device in contact with the image bearing member from preceding transfer of toner image to succeeding transfer of toner image, as at least one of the areas between successive images on the image bearing member without the toner patch passes through the transfer area during continuous printing; and moving the transfer device to one of at least two different separation positions away from the image bearing member as the toner patch on the image bearing member passes through the transfer area during a time other than continuous printing, wherein a first distance between the transfer device and the image bearing member at a first separation position when the toner patch passes through the transfer area is shorter than a second distance at a second separation position different from the first separation position.

10. The method according to claim 9, wherein a time during which the at least one of the areas between successive toner images on the image bearing member passes through the transfer area while the transfer member remains in contact with the image bearing member is shorter than a time during which the area with the toner patch passes through the transfer area.

11. The method according to claim 9, further comprising:

moving the transfer device from any one of the separation positions to contact the image bearing member with a single operation; and moving the transfer device from the image bearing member to one of the separation positions with a single operation.

12. The method according to claim 11, further comprising:

moving the transfer device to the same separation position as the position when the toner patch passes through the transfer area, before the leading edge of a recording medium enters the transfer area when forming an image on the recording medium; and moving the transfer device to contact the image bearing member after the leading edge of the recording medium enters the transfer area.

13. The method according to claim 9, further comprising:

detecting an amount of toner adhered to the toner patch for adjustment of a density of toner with a toner detector; and adjusting a density of an image based on a detection result in the detecting using a the density adjustment controller, the density adjustment controller controlling at least one of a toner supply unit, a developing bias applicator, and a charging bias applicator to adjust a density of an image.

14. An image forming apparatus comprising, a moving device configured to move a transfer member to one of at least two different separation positions as the transfer member is separated from an image bearing member, a moving device controller configured to control the moving device to move a transfer device to one of the at least two different separation positions during a time other than continuous printing, wherein as a toner patch passes through a transfer area and the transfer member is separated from the image bearing member, a first distance between the transfer device and the image bearing member at a first separation position when the toner patch passes through the transfer area is shorter than a second distance at a second separation position different from the first separation positions.

15. The image forming apparatus according to claim 14, wherein the moving device moves the transfer device from any one of the separation positions to contact the image bearing member with a single operation, and the moving device separates the transfer device from the image bearing member to any one of the separation positions with a single operation.

16. The image forming apparatus according to claim 15, wherein the moving device comprises a cam to contact the transfer device and a driving device to rotate the cam.

* * * * *